US008001916B2

(12) United States Patent
Cook et al.

(10) Patent No.: US 8,001,916 B2
(45) **Date of Patent: *Aug. 23, 2011**

(54) MEGA YACHT MAST TRACKING SYSTEM WITH ARTICULATING SAIL FEEDER

(75) Inventors: Fred C. Cook, Assonet, MA (US); William H. Donaldson, Middletown, RI (US)

(73) Assignee: Schaefer Marine, Inc., New Bedford, MA (US)

( * ) Notice: Subject to any disclaimer, the term of this patent is extended or adjusted under 35 U.S.C. 154(b) by 201 days.

This patent is subject to a terminal disclaimer.

(21) Appl. No.: 12/437,086

(22) Filed: May 7, 2009

(65) Prior Publication Data

US 2010/0282152 A1 Nov. 11, 2010

(51) Int. Cl.
*B63H 9/04* (2006.01)

(52) U.S. Cl. ..... 114/102.15

(58) Field of Classification Search ..... 114/102.1, 114/102.12, 102.15, 102.16, 102.18, 104, 114/108, 111, 112, 102.24, 102.27, 102.29, 114/102.32, 102.33

See application file for complete search history.

(56) References Cited

U.S. PATENT DOCUMENTS 3,058,138 A * 10/1962 Tomlinson ..... 184/100
3,331,348 A 7/1967 Dyer
4,228,755 A * 10/1980 Graham ..... 114/111
4,236,475 A 12/1980 Merry
4,597,347 A 7/1986 Spanopoulos
4,821,664 A 4/1989 Dahmen
5,127,351 A 7/1992 Breems
5,305,700 A 4/1994 Strong et al.
5,546,881 A 8/1996 Frederiksen
5,697,314 A 12/1997 Clausin
6,145,460 A 11/2000 Brookes
6,371,037 B1 4/2002 Cook et al.
6,575,108 B1 6/2003 Lindström

OTHER PUBLICATIONS

Hasse, C., "A Mainsail for All Seasons," *Cruising World*, pp. 1-3, [online]. Sep. 2, 2002, [retrieved on Mar. 18, 2009]. Retrieved from the Internet URL:http://www.cruisingworld.com/article_print.jsp?ID=201148.

Hasse, C., "Cruising Sales: Mainsails," *Cruising Mainsails*, pp. 1-9, [online]. Apr. 30, 2004, [retrieved on Mar. 18, 2009]. Retrieved from the Internet URL:http://www.porttownsendsails.com/articles.htm-.

* cited by examiner

*Primary Examiner* — Daniel Venne
(74) *Attorney, Agent, or Firm* — Hamilton, Brook, Smith & Reynolds, P.C.

(57) ABSTRACT

Disclosed is an articulating sail feeder that solves problems associated with furling and reefing sails on yachts, particularly large yachts. The inventive sail feeder includes hinge tracks arranged in articulating column that bends and rotates freely, but limits the axial twist of the sail as during furling and reefing. The inventive hinge tracks have a cross section that includes a batten end receptacle with channels for headboard cars. Hinge tracks with the inventive cross section absorb the wind-generated compressive forces exerted by the battens on the batten pockets, reducing chafing, and eliminate the need for sail slides, which would otherwise lock the sail in place during furling and reefing.

16 Claims, 9 Drawing Sheets

MEGA YACHT MAST TRACKING SYSTEM WITH ARTICULATING SAIL FEEDER

RELATED APPLICATIONS

This application is related to U.S. application Ser. No. 12/437,076, "Mast Track with External Headboard Car," and U.S. application Ser. No. 12/437,062, "Sectionalized Mast Track," both of which are being filed on the same day as the instant application. The subject matter of this application is also related to U.S. Pat. No. 6,371,037, "Sail Furling System," to Cook et al. filed on Dec. 26, 2000.

The above-referenced applications and patent are incorporated herein by reference in their entireties.

BACKGROUND OF THE INVENTION

Furling and reefing are separate, but related activities involving hoisting and lowering sails on yachts and sailboats. Furling is completely retiring a sail from use so that the furled sail no longer presents any cross section to the wind for driving the boat. Reefing, on the other hand, refers to reducing the sail area to provide less cross section to the wind, reducing the driving force of the wind on the sail. Since most furlers are also used as reefers, the terms are used interchangeably herein.

Before the advent of furlers, at least two people were needed to hoist and lower the sails on larger yachts. Prior art furlers are intended to allow a single person to hoist and lower sails on large yachts, even those longer than 40 feet. Many of the first mainsail furlers were mast furlers designed to furl the mainsail within the mast, allowing the lower edge, or foot, of the sail to slide along the boom toward the mast as the sail is furled. Unfortunately, mast furlers increase the weight aloft, affecting the stability of the vessel under sail. Mast furlers are also difficult to maintain, as fixing even simple malfunctions, such as jams, requires someone to go aloft, a dangerous and time-consuming activity.

Boom furlers, on the other hand, are configured to furl the sail inside the yacht's boom, which extends perpendicularly from the mast at the foot of the sail. Depending on the configuration, the foot of the sail may be attached to the mandrel along its length or attached only at the tack and clew (i.e., the forward and aft corners along the foot of the sail). A winding cord attaches the sail to a drum inside the boom. Rotating the drum causes the sail to wind (or unwind) around a mandrel inside the boom. Because the boom furler is close to the deck, boom furlers are easier to maintain than mast furlers and do not affect the stability of the yacht.

Unfortunately, most boom furlers must be installed apart from the mast, creating a space between the mast and the furler where the sail deforms. This deformation tends to increase when the sail is wound down, causing folds in the ends of the winding. In addition, this configuration increases stress on the bolt rope, which is sewn into the sail to aid in feeding the sail into the boom or mast. Increased stress on the bolt rope makes it more difficult to wind or unwind the sail.

Prior art solutions described in U.S. Pat. No. 5,697,314 to Clausin include using pulleys to offset the drum or relieve stress on the bolt rope. Pulleys introduce friction, making it difficult to wind and unwind the sail; they also require linkages that must remain taut. Clausin also discloses a recessed bolt rope slot and bolt rope guide that relieve stress on the bolt rope. U.S. Pat. No. 4,236,475 to Merry teaches a simpler, two-pronged metal guide for aligning the bolt rope with mast, preventing the bolt rope from jamming as the sail is raised or lowered. Neither of these bolt rope guides is sufficiently strong to handle the stresses of larger sails, such as those used on yachts of 40 feet or more in length.

SUMMARY OF THE INVENTION

Embodiments of the present invention include an articulating sail feeder and method for using an articulating sail feeder for a yacht. Example articulating sail feeders include herein called "hinge tracks" arranged in an articulating column with a longitudinal axis substantially parallel to a mast of a yacht, where the hinge tracks are configured to receive a sail luff. Herein referenced "limiting pins" and ball joints in the articulating column enables lateral and rotational movement of the sail. The limiting pins, which are pins disposed between respective pairs of adjacent hinge tracks, limit the movement of a given hinge track with respect to a neighboring hinge track and thus are referred to herein as "limiting pins". The ball joints, which are also disposed between respective pairs of adjacent hinge tracks, receive a tensioning line that runs along the longitudinal axis of the articulating column.

In certain embodiments, the articulating column enables the sail to move and rotate freely in a lateral direction with limited axial twist as the sail is being furled or reefed. This free rotation may be achieved using limiting pins formed of two frustums, or truncated conical sections, that are placed base-to-base and separated by a flange. The slope of the frustums determines, in part, the range of motion and may allow universal axial motion.

The articulating column's range of motion may also be adjusted using the tensioning line, which may be a flexible wire, cable, rod, or synthetic rope. Embodiments of the articulating sail feeder include means for adjusting tension of the tensioning line, such as wrenches or hydraulic cylinders. The means for adjusting tension of the tensioning line may be situated at either end or both ends of the tensioning line.

The hinge tracks may have a cross section comprising a batten guide, or luff extrusion, formed of two substantially parallel batten guide arms. A luff passage connects the batten guide to a luff rope slot formed forward of the batten guide. Example luff extrusions may include a channel configured to guide a headboard car along an axis substantially parallel to the long axis of the mast.

The articulating sail feeder may be configured to be coupled to a mast track for a yacht, such as a sectionalized mast track. Sectionalized mast tracks may include multiple mast track sections arranged in a column configured to be attached to a mast. Each mast track section may include an upper receiver and a lower receiver, both of which may be oriented along the longitudinal axis of the column. Neighboring mast track sections may be secured using respective securing pins configured to be received by a lower receiver of one mast track section and an upper receiver of the adjacent mast track section.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
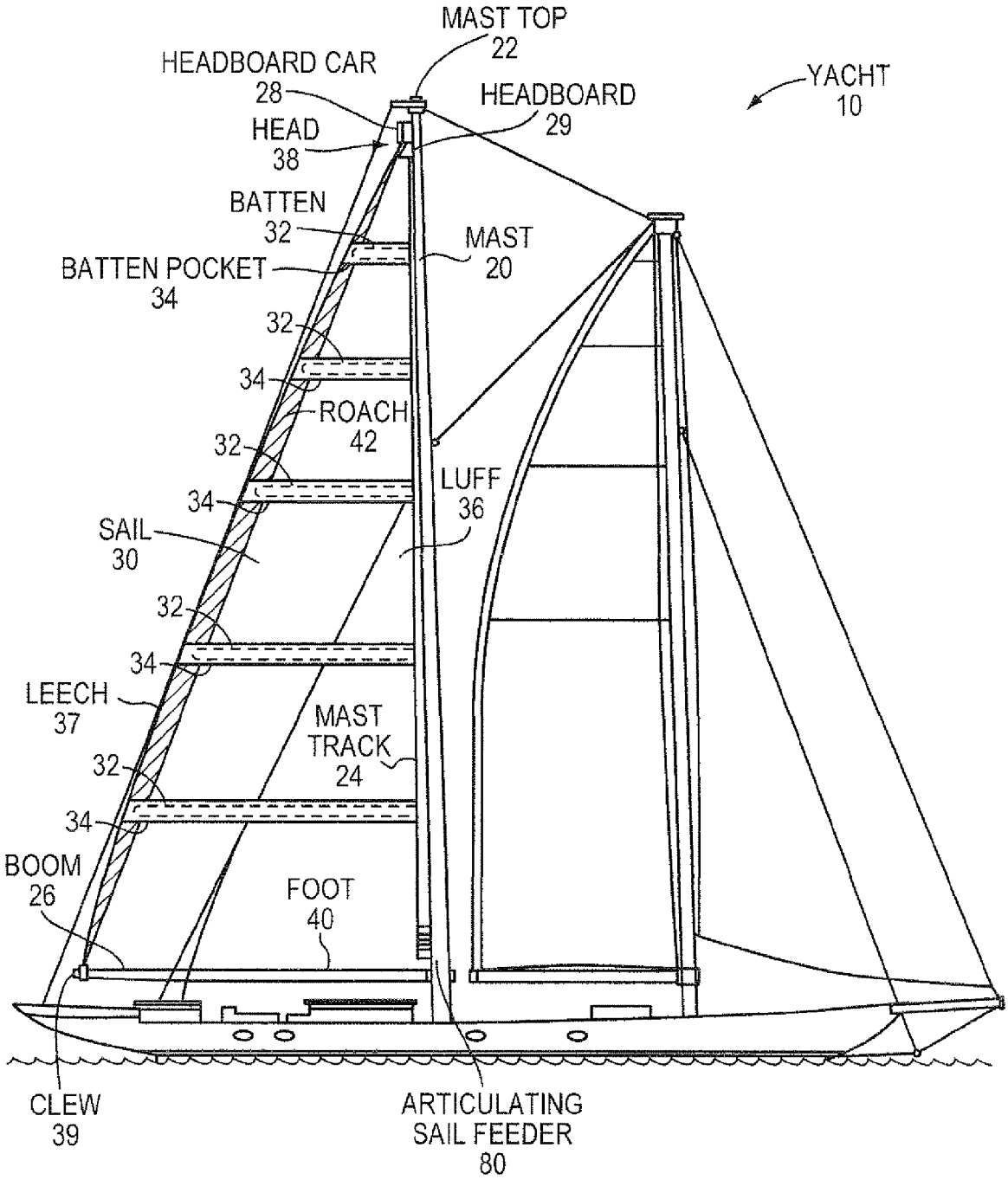
FIG. 1 is an elevation view of a yacht employing an example articulating sail feeder of the present invention.

FIG. 1 shows a yacht 10 with a mast 20 and a boom 26. The boom 26 stores a sail 30, which may be raised with a halyard (not shown) and a headboard car 28 to capture wind and propel the yacht 10. The headboard car 28 is coupled to a headboard 29 that reinforces the head 38 of the sail 30 to prevent high loads from tearing apart the head 38. A mast track 24 guides the headboard car 28 and a luff rope (not shown; also known as a sail bolt rope or bolt rope) stitched into the forward edge, or luff 36, of the sail 30 along an axis parallel to the long axis of the mast 20. Although the headboard car 28 shown in FIG. 1 travels along a channel on the outside of the mast track 24, alternative headboard ears may be configured to travel within a groove internal to the mast track 24.

The sail 30 shown in FIG. 1 is a fully battened mainsail 30 with battens 32 that run generally parallel to the bottom edge, or foot 40, of the sail 30 from the luff 36 (leading edge) to the trailing edge, or leech 37, of the sail 30. The battens 32 are stitched into batten pockets 34 in the sail 30. Standard battens (not shown) run only partway from the luff 36 to the leech 37, trading long-term performance for reduced chafing and easier handling. Battens may be oriented in other directions or combinations of directions; for example, alternative battens may run perpendicularly from the leech 37 to intersect the foot 40 and the luff 36 at substantially complementary angles.

Full battens 32 support roach 42, the sail area that lies outside a straight line from the head 38 to the lower aft corner, or clew 39, of the sail 30. Typically, the supporting battens 32 are about three times longer than the roach 42 that they support. Roach 42 enhances sail performance by adding 15-30% more sail area to a triangular sail, such as the sail 30 shown in FIG. 1. More importantly, mainsails with roach 42 have elliptically shaped heads and planforms that improve performance on all points of sail, particularly to weather.

Unfortunately, full-length battens 32 reduce the life of the sail 30 by chafing against the batten pockets 34. The same forces that pull the sail 30 taut to propel the yacht 10 push the battens 32 towards the mast 20, causing the battens 32 to chafe against the batten pockets 34. Eventually, this chafing causes the battens 32 to tear or poke through the forward ends of the batten pockets 34. Reinforcing the batten pockets 34 alleviates this problem on vessels with smaller sails, but reinforcement is not sufficient to withstand chafing due to the larger compressive forces exerted on battens 32 in larger sails. In addition, compression increases friction on the sail slides that run in mast tracks 24 and in articulating sail feeders 80 without headboard cars 28, making it difficult to raise, lower, or reef the sail 30.

An articulating sail feeder 80 coupled to the bottom of the mast track 24 limits the sail's range of motion as the sail 30 is fed into the boom 26 by a boom furler (not shown), making it easier to reef and furl the sail 30. In yachts 10 without the present inventive articulating sail feeder 80, the sail 30 deforms in the space above the boom 26 during winding, causing folds in the ends of the winding. The articulating sail feeder 80 moves with the sail 30 as the sail 30 is being furled or reefed, preventing deformation and relieving stress on the bolt rope (not shown), which is sewn into the edge of the sail 30 to prevent fraying. The articulating sail feeder 80 allows the sail 30 to move and rotate freely from side to side (i.e., laterally), while preventing the sail from twisting too much around an axis parallel to the long axis of the mast 20.

Figure 2:
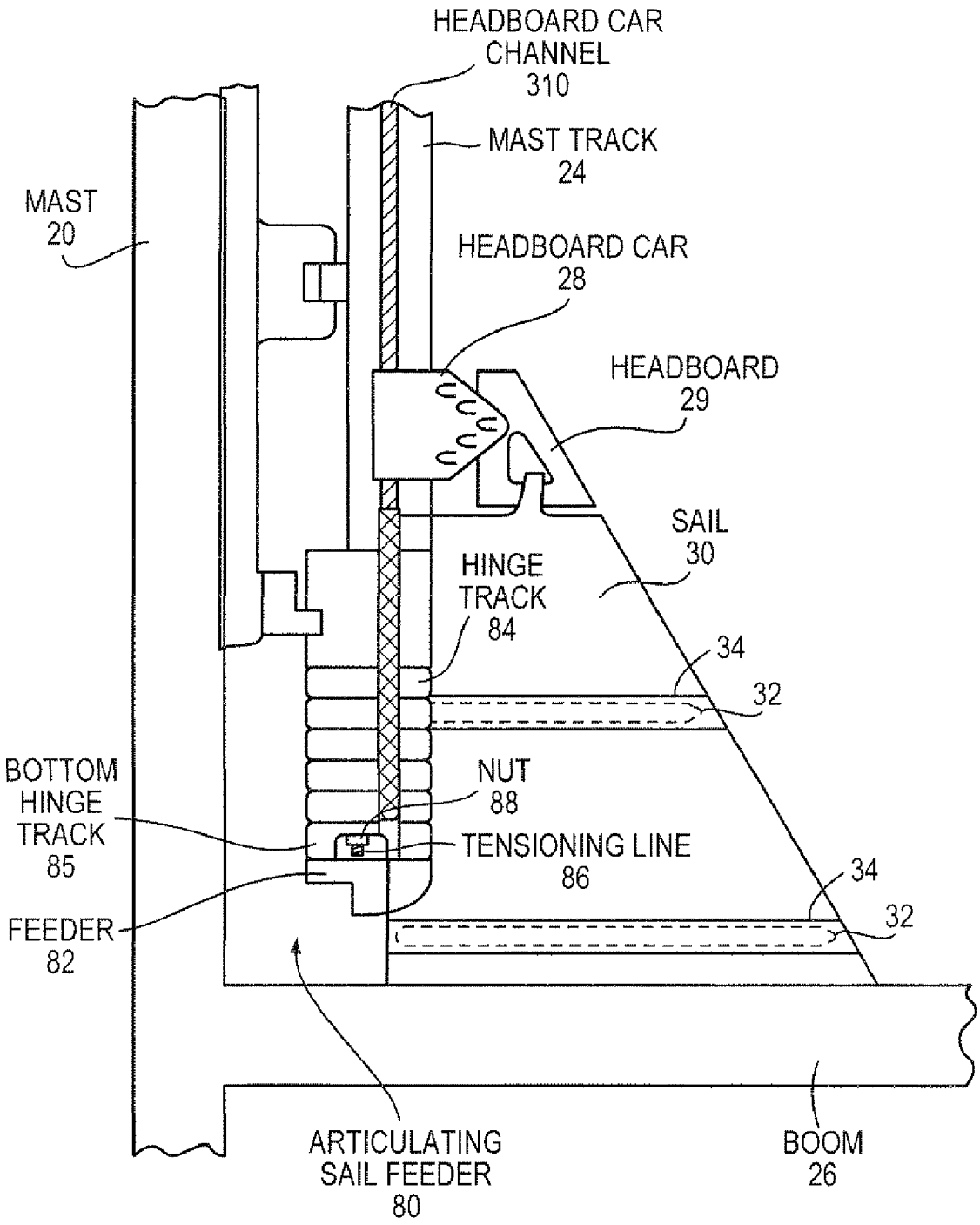
FIG. 2 is an elevation view of a mast, boom, and example articulating sail feeder of the present invention.

FIG. 2 shows an example articulating sail feeder 80 coupled to the bottom of a mast track 24. The lower end of the articulating sail feeder 80 is suspended from the mast 20 above the boom 26 to allow free lateral movement of the sail 30 as the sail 30 is raised or lowered using the headboard car 28 coupled to the headboard 29. Pulling (or releasing) the halyard (not shown) attached to the headboard car 28 causes the headboard car 28 to travel up (or down) a headboard car channel 310, raising (or lowering) the sail 30.

The articulating sail feeder 80 flexes and twists as the sail 30 is wound down, reducing deformation of the sail 30 and eliminating folds in the ends of the winding. The articulating sail feeder 80 also reduces stress on the bolt rope by flexing and bending, making it easier to wind or unwind the sail 30. In addition, the articulating sail feeder 80 may be configured to enable limited twist or rotation about an axis parallel to the longitudinal axis of the mast 20 as the sail 30 is furled or reefed. The articulating sail feeder 80 may also flex fore and aft (i.e., in the plane of the page) or abeam (i.e., into and out of the page).

A feeder 82 at the bottom of the articulating sail feeder 80 guides the sail 30 into and out of the articulating sail feeder 80, which includes several track members herein called hinge tracks 84 arranged in a column between the feeder 82 and the bottom edge of the mast track 24. A threaded tensioning line 86 runs through the hinge tracks 84 along the interior of the column. A nut 88 secures the lower end of the tensioning line 86 in a bottom hinge track 85. Adjusting the nut 88 changes the tension of the tensioning line 86, altering the articulating sail feeder's range of motion.

Figures 3A, 3B:
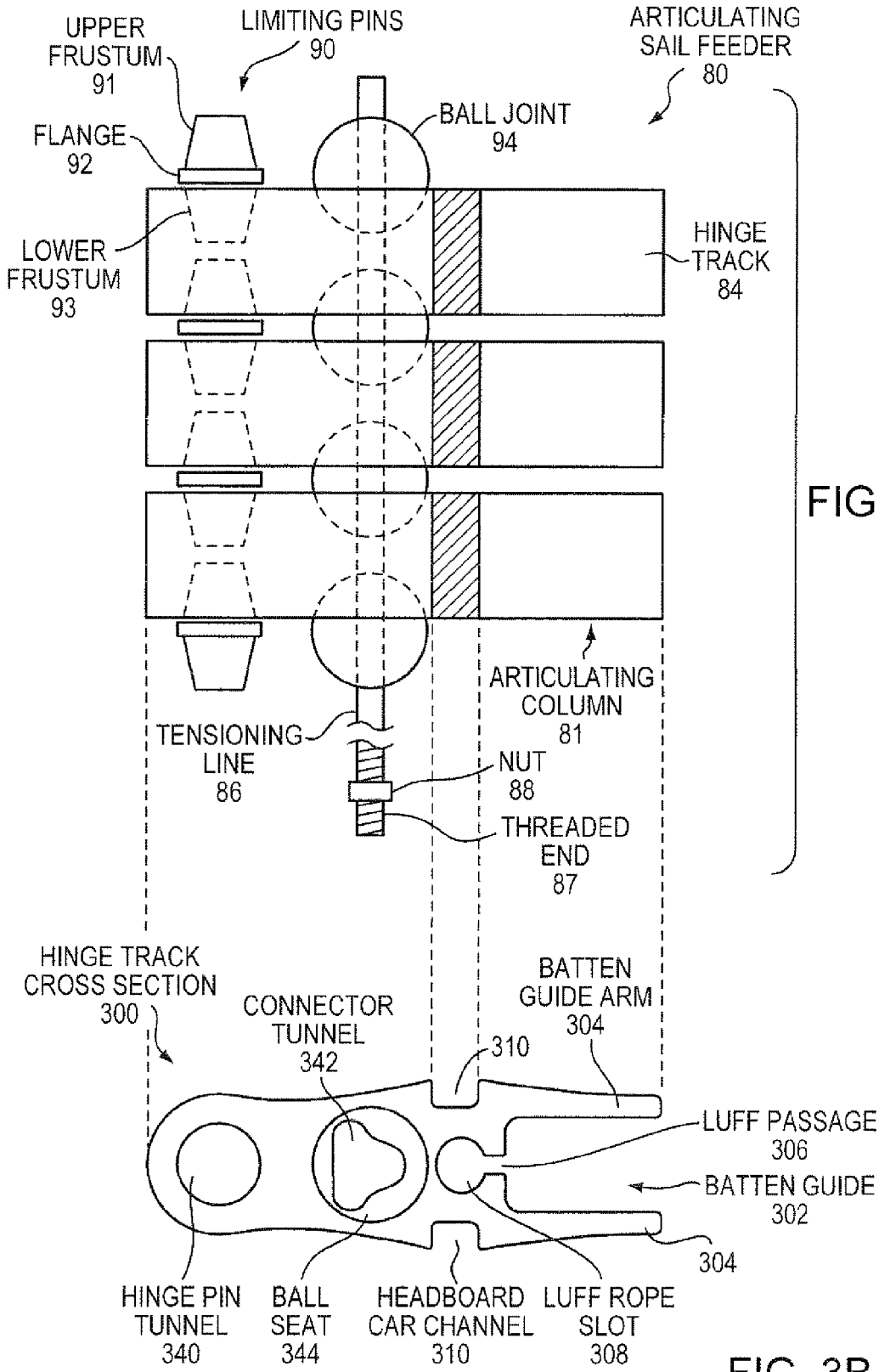
FIGS. 3A and 3B are, respectively, an elevation view of an example articulating sail feeder and a plan view of a hinge track of the example articulating sail feeder in the present invention.

FIGS. 3-6 show various views of an articulating sail feeder 80 and some of its components, including hinge tracks 84, limiting pins 90, and ball joints 94, FIGS. 3A and 3B include, respectively, an elevation view of an articulating sail feeder 80 and a plan view of a hinge track 84. The articulating sail feeder 80 includes plural hinge tracks 84 arranged in an articulating column 81 like vertebrae in a spine. Limiting pins 90 and balls joints 94 arranged between respective pairs of adjacent hinge tracks 84 limit the motion of the column 81.

Figure 4:
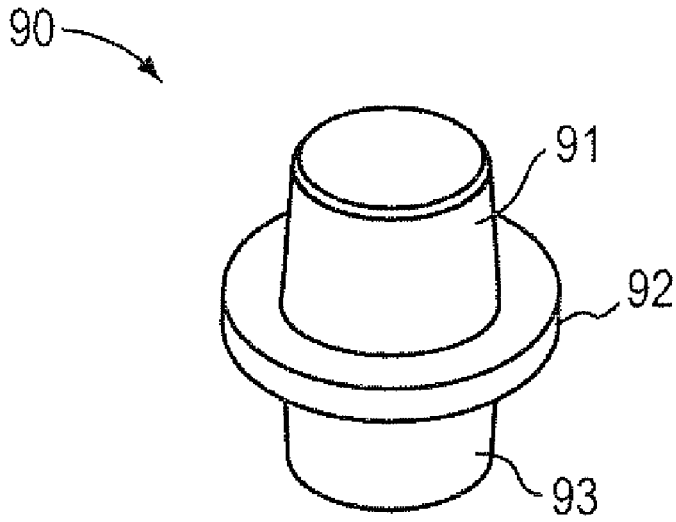
FIG. 4 is a perspective view of a limiting pin used in embodiments of the present invention.

As shown in FIGS. 3A and 4, each limiting pin 90 is formed of upper and lower truncated conical sections, or frustums 91 and 93, attached to a flange 92. The flange 92 separates a respective pair of neighboring hinge tracks 84, which receive the upper and lower frustums 91 and 93 in respective recesses 340. In a preferred embodiment, the limiting pins 90 are formed of nylon that has a low coefficient of thermal expansion, high strength, and high rigidity, such as Nylatron GS. Typically, the edges of the limiting pins 90 are beveled or radiused and the pins 90 themselves are deburred.

The cone angle of the sides of the frustums 91 and 93 fixes the maximum bend angle between adjacent pairs of hinge tracks 84, preventing the articulating column 81 from bending too much in one direction or another. Because the limiting pins 90 are symmetric about the longitudinal axis of the column 81, they permit universal axial motion (i.e., rotation) about the longitudinal axis of the column 81.

Figure 5:
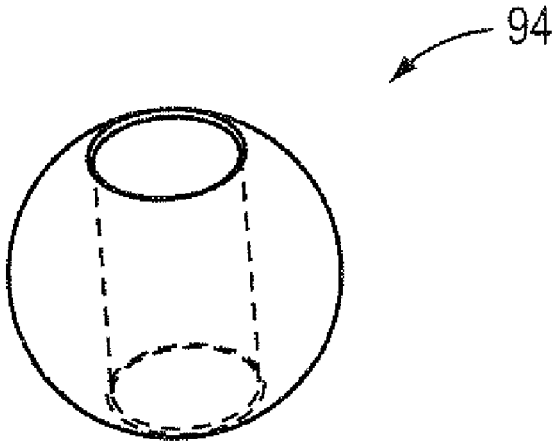
FIG. 5 is a perspective view of a ball joint used in embodiments of the present invention.

Each ball joint 94 is disposed between a respective pair of neighboring hinge tracks 84 in seats 344 aft of the limiting pin recesses 340 and forward of batten guides 302 shown in FIGS. 3B and 6A-C. The ball joints 94 receive a tensioning line 86 that runs through the column 81 via holes along the diameters of the ball joints 94. FIG. 5 is illustrative of the holes along the ball joint 94 diameter. Like the limiting pins 90, the ball joints 94 may be formed of nylon that has a low coefficient of thermal expansion, high strength, and high rigidity, such as Nylatron GS. Typically, the edges of the ball joints 94 are beveled or radiused and the ball joints 94 themselves are deburred.

The tensioning line 86 may be a flexible wire, cable, rod, synthetic rope, or any other suitable line or cable. As shown in FIG. 3A, the tensioning line 86 includes a threaded end 87 that receives a nut 88. Increasing the tension on the tensioning line 86 by tightening the nut 88 presses (vertically compresses) the hinge tracks 84 together, reducing the column's range of motion. Conversely, reducing the tension on the tensioning line 86 by loosening the nut 88 relieves pressures on the hinge tracks 84, increasing the column's range of motion. Other embodiments may includes other tensioning means such as hydraulic or pneumatic cylinders arranged at the upper end, lower end, or both ends of the tensioning line 86.

FIGS. 3B and 6A-C show the cross section 300 of the hinge of a hinge track 84; this cross section 300 is also known as a luff extrusion. A hinge track 84 with the luff extrusion cross section 300 shown in FIG. 3B solves the problem of batten poke or chafing by providing a batten guide 302 that receives battens along the length of the mast 20, such as the full battens 32 shown in FIG. 1. The present inventive hinge track cross section 300 also eliminates problems associated with friction-locked sail slides by providing a channel 310 for a headboard car 28 (FIG. 1) that eliminates the need for sail slides.

The hinge track cross section 300 includes a pair of substantially parallel batten guide arms 304 that form the batten guide 302. A luff passage 306 connects the batten guide 302 to a luff rope slot 308 configured to hold a luff rope sewn into the luff 36 of the sail 30. As wind fills the sail 30, compressing the battens 32 (FIG. 1), the battens 32 push against the forward edge of the batten guide 302, reducing chafing on the sail bolt rope. The batten guide arms 304 also stabilize battens 32 subject to rotational forces. The upper and lower surfaces of the batten guide arms 304 are also beveled slightly (e.g., by 2.5°) in one embodiment shown in FIG. 6C to allow the articulating column 81 to bend and flex along the plane of the sail 30.

Figure 6A:
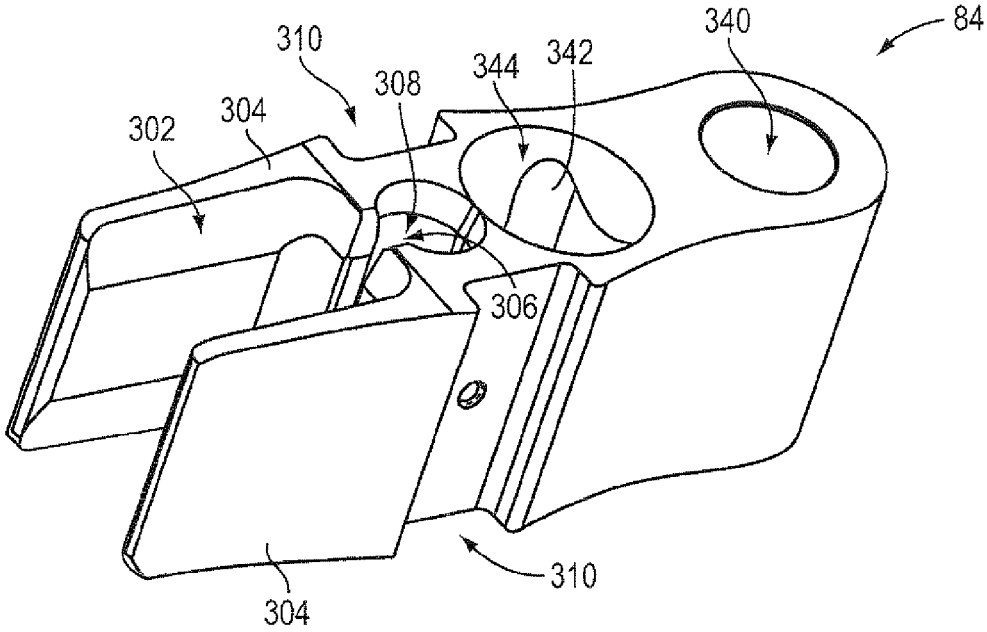
FIGS. 6A-C include plan and elevation views, respectively, of a hinge track according to embodiments of the present invention.
Figure 6B:
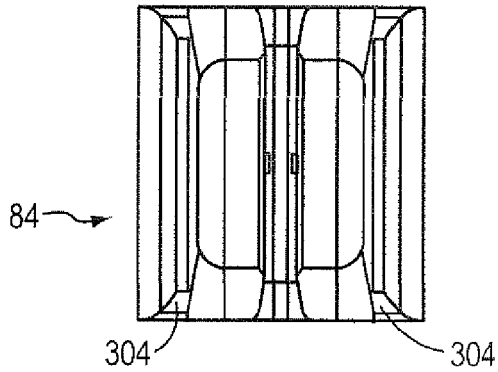
Figure 6C:
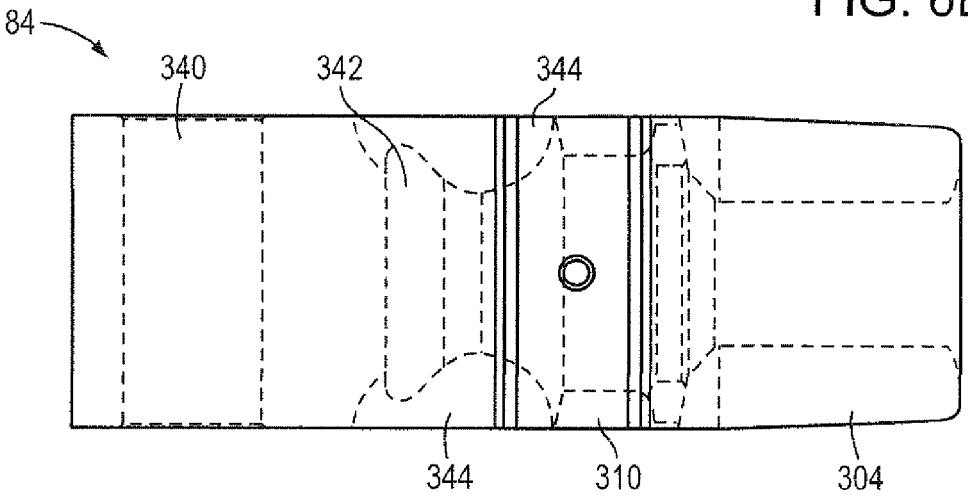

The cross section 300 also includes a hinge pin tunnel 340 configured to receive limiting pins 90 and a ball seat 344 configured to receive ball joints 94. Each hinge track 84 has a connector tunnel 342 that connects the upper and lower ball seats 344, as shown in FIG. 6C. The tunnels 340 and 342 may extend through the entire thickness of the hinge track 84 with a constant shape and size. Alternatively, they may be configured to have upper and lower receptacles to prevent neighboring limiting pins 90 and ball joints 94 from touching each other.

As shown in FIG. 3B, the headboard car channel 310 is formed substantially next to (i.e., abeam of) the luff rope slot 308, defining a travel axis for the headboard car 28 (FIG. 1) that is substantially coincident with the axis formed by the luff rope slot 308. Because the headboard car 28 and the luff rope (not shown) travel along the same axis, torque on the headboard car 28 or the headboard 29 (FIG. 1) in the plane of the sail 30 is less likely to cause the headboard car 28 to shift, jam, or stick in the headboard car channel 310. As a result, the luff rope and headboard car 28 travel freely up and down an axis parallel to the longitudinal axis of the mast 20.

In a preferred embodiment, the hinge tracks 84 are each about five and a half inches long, about two inches high, and vary in width from just under two inches just forward of the headboard car channel 28 to about one and a quarter inches at the channel 28 itself. The headboard car channels 310 are each about seven-eighths of an inch wide and about one-quarter inch deep. The batten guide arms 304 are just under one and three-quarters inch long, forming a batten guide 302 of same length and a width of about one inch. The luff passage 306 may be about one-fifth of an inch wide and about one-quarter of an inch long. The luff rope slot 308 has a radius of about three-tenths of an inch. Edges of hinge tracks 84 with the present inventive luff extrusion cross section 300 may be beveled, chamfered, and/or radiused as appropriate.

Figure 7A:
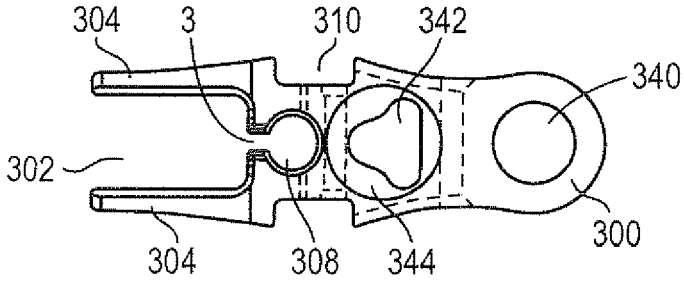
FIGS. 7A and 7B are plan and elevation views, respectively, of a bottom hinge track of the present invention.
Figure 7B:
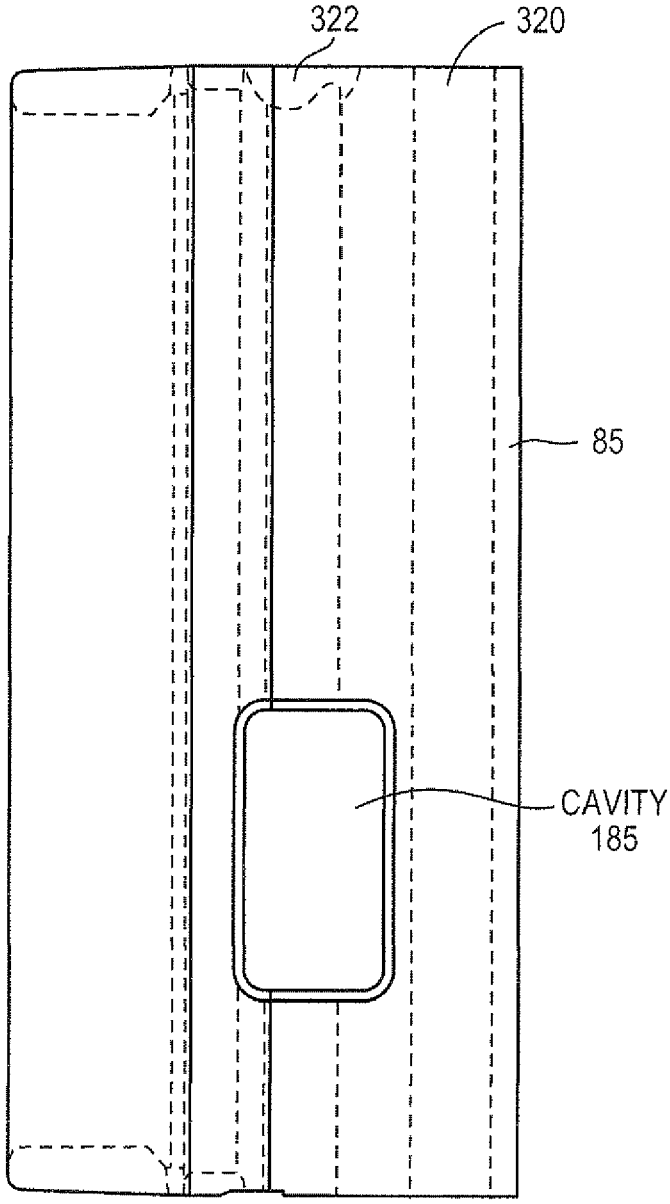
Figure 8A:
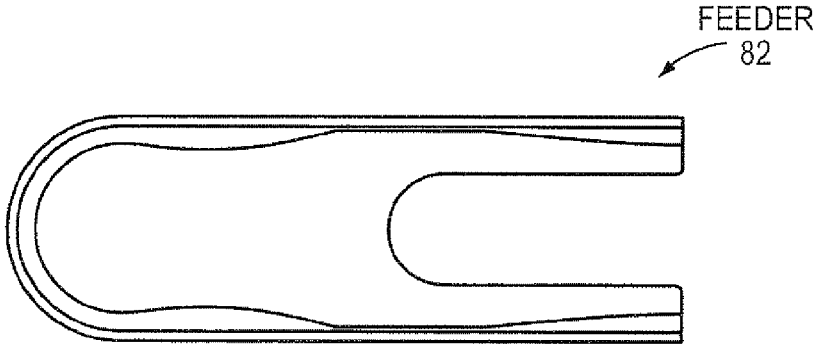
FIGS. 8A-E include different perspective views of a feeder section of the present invention.
Figure 8C:
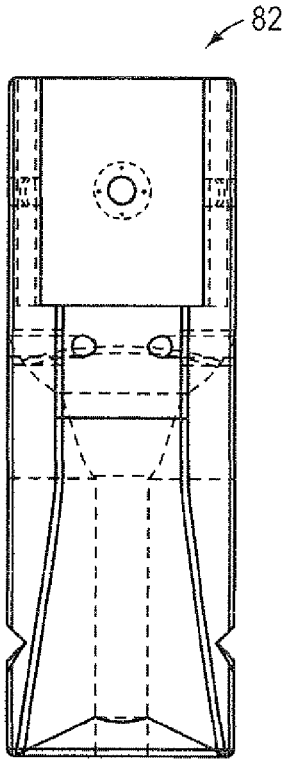
Figure 8B:
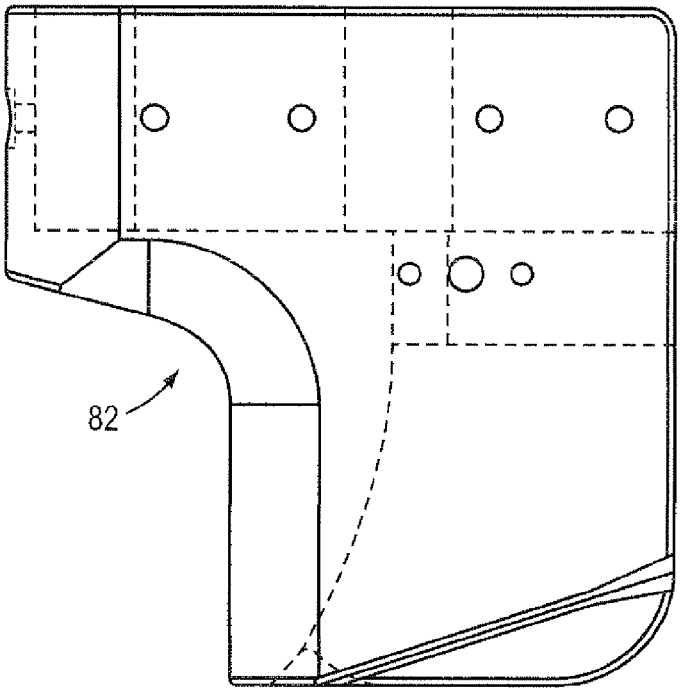
Figure 8E:
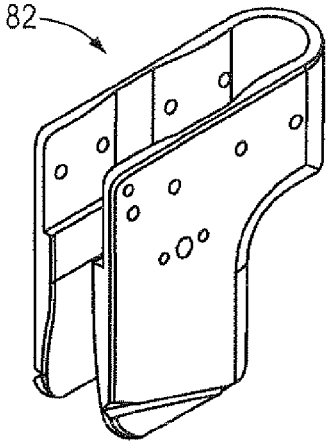
Figure 8D:
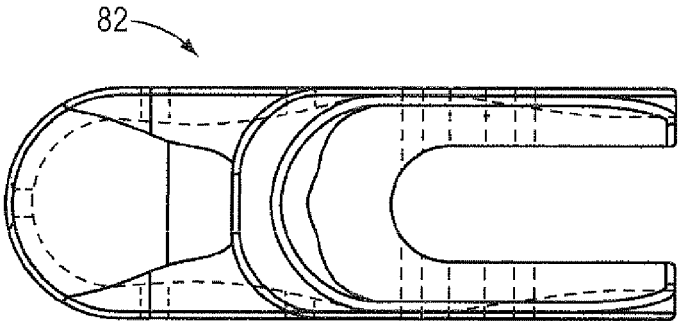

FIGS. 7A-B shows a bottom hinge track 85 of the articulating sail feeder 80 shown in FIGS. 2 and 3. Like the hinge tracks 84, the bottom hinge track 85 has a luff extrusion cross section 300 with batten guide arms 304 that form a batten guide 302, which is connected to a luff rope slot 308 by a luff passage 306. The bottom hinge track 85 has only one ball seat 344, located on the upper surface of the bottom hinge track 85. The tensioning line 86 runs through the ball joint 94 (not shown) and connector tunnel 342 and terminates in a cavity 185 in the bottom hinge track 85.

The cavity 185 accommodates tensioning means attached to the lower end of the tensioning line 86 for adjusting the tension of the tensioning line 86. For example, the tensioning means may include a nut 88 (FIG. 2) attached to a threaded tensioning line 86 or hydraulic or pneumatic cylinders. Increasing the tension decreases the articulating sail feeder's range of motion; decreasing the tension increases the articulating sail feeder's range of motion. In preferred embodiments, the cavity 185 is about three inches high by one and a half inches long; the cavity's upper edge is about seven inches from the upper edge of the bottom hinge track 85. The bottom hinge track 85 is about one foot, one-quarter inch high, by about five and a half inches long, by about two inches wide at its widest point.

The hinge tracks 84 and bottom hinge track 85 may be fabricated of carbon fiber, 6005 aluminum alloy, or any other suitable material. Generally, suitable materials are at least moderately strong; capable of bending, flexing and twisting; suitable for machining, welding, and brazing; and corrosion resistant (or able to be treated or coated with corrosion-resistant material). For example, the hinge tracks 84 may have a clear anodized finish. Hinge tracks 84 and bottom hinge tracks 85 may be made by machining, extrusion, or any other suitable manufacturing technique.

FIGS. 8A-E are views from different perspectives of a feeder 82 configured to be coupled to the lower end of the bottom hinge track 85 as shown in FIG. 2. The feeder 82 is scoop-shaped to guide the sail through the free space between the articulating sail feeder 80 and the boom 26. In preferred embodiments, the feeder 82 is about six inches high at its tallest, two inches wide, and just under six inches long. The feeder 82 may be made of any sufficiently strong, corrosion-resistant material, such as grade 316 stainless steel finished with a tumble burnish and/or electrolytic polish.

Figure 9A:
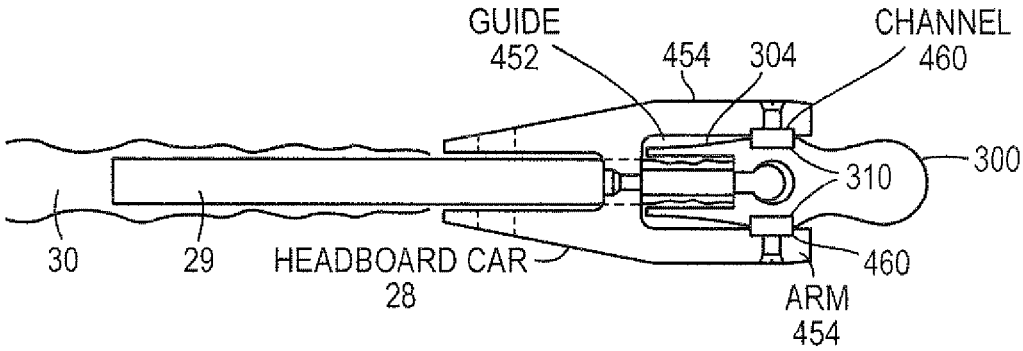
FIGS. 9A and 9B are plan and elevation views, respectively, of an external headboard car, headboard, and mast track suitable for use with an example inventive luff extrusion cross section in one embodiment of the present invention.
Figure 9B:
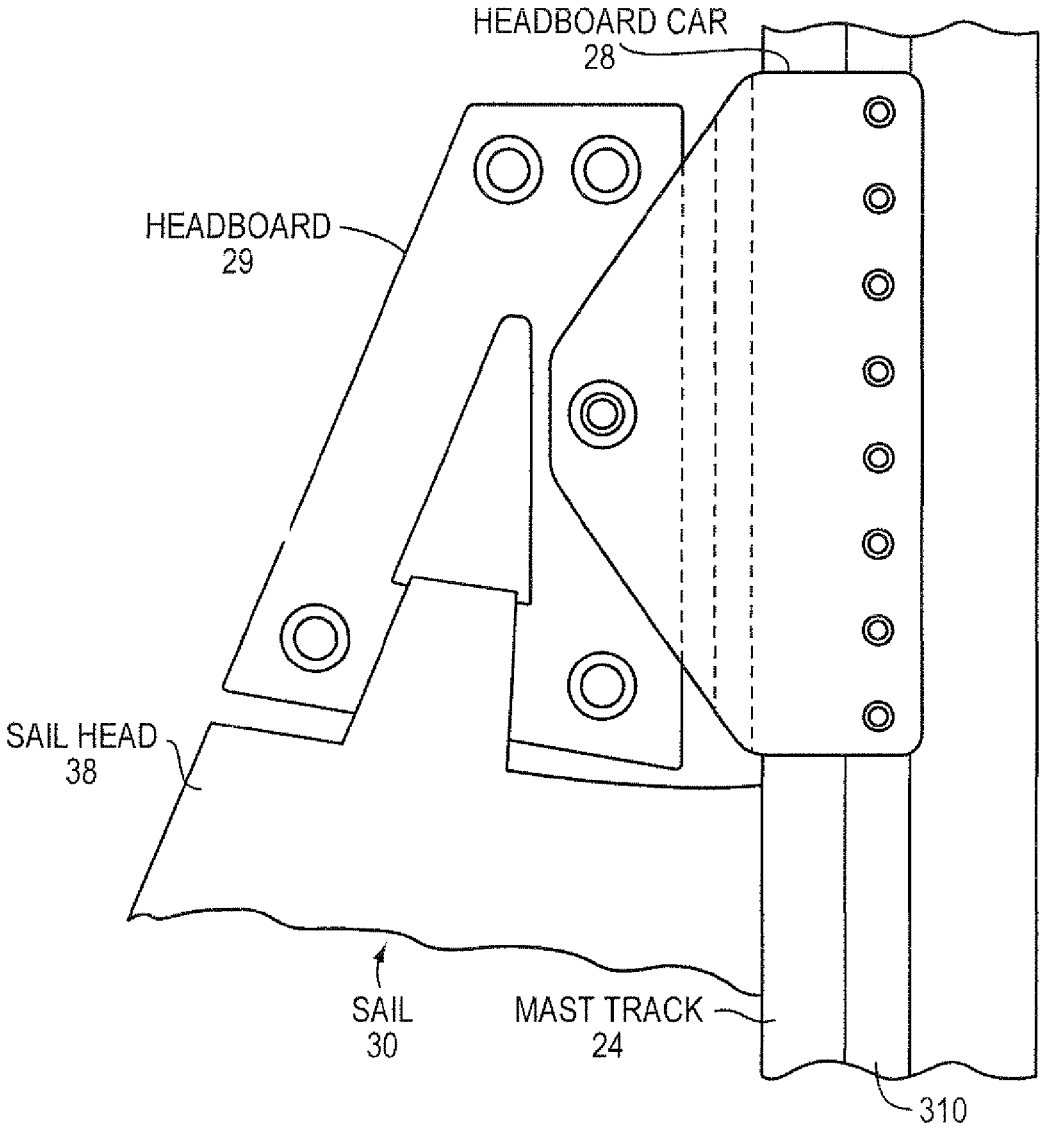

FIGS. 9A and 9B are, respectively, plan and elevations views of a sail 30, headboard car 28, and mast track 24 with the present inventive luff extrusion cross section 300. The headboard car 28, which is coupled to the head 38 of a sail 30 via a headboard 29, includes a guide 452 formed of two substantially parallel arms 454 that fit around the outside of the luff extrusion 300. The arms 454 on the headboard car 28 have channels 460 that mate with the complementary channels 310 on the luff extrusion 300. Bearings (not shown) between the channels 310 on the luff extrusion 300 and the channels 460 on the headboard car 28 allow the headboard car 28 to travel freely along an axis substantially parallel to the mast 20 (FIG. 1).

Because the headboard car 28 travels smoothly along the bearings between the channels 460 and 310, the sail 30 can be raised and lowered with a halyard (not shown) attached to the headboard car 28. In contrast to conventional sails, which are raised with halyards attached directly to the head 38 or the headboard 29, sails 30 coupled to headboard cars 28 in embodiments of the present invention do not need sail slides to ensure smooth travel of the sail up and down the mast. As a result, sails 30 raised with headboard cars 28 configured with luff extrusions 300 of the present invention do not suffer from the compression- and torque-induced friction that locks sail slides into place.

In a preferred embodiment, the headboard car 28 is made of aluminum or any other suitably strong, light, and corrosion-resistant material. The guide 452 is wide enough and long enough to substantially accommodate the luff extrusion 300. For example, the arms 454 may be about five inches long and spaced about two inches apart. The edges of the headboard car 28 may be beveled, chamfered, and/or radiused as appropriate.

Figure 10:
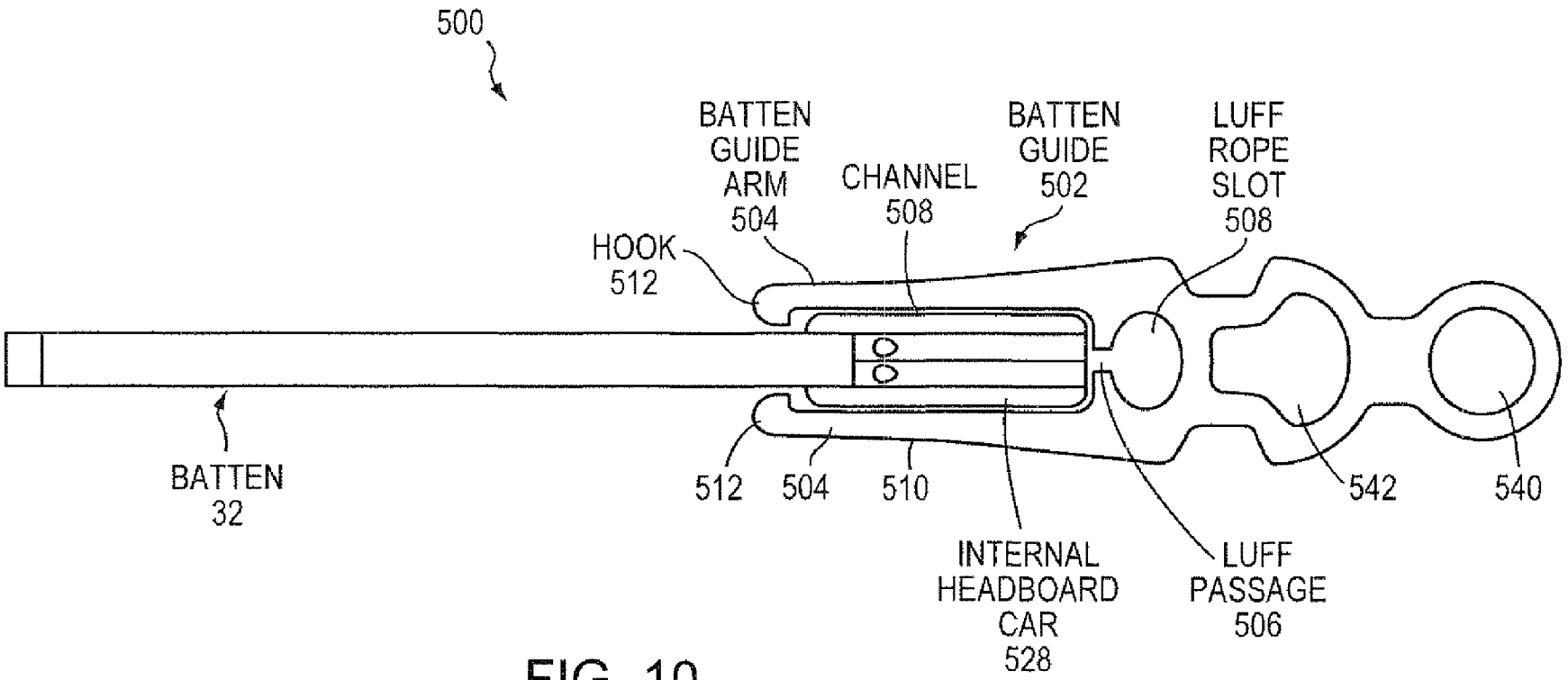
FIG. 10 is a plan view of a hinge track cross section suitable for use with an internal headboard car according to alternative embodiments of the present invention.

FIG. 10 is a plan view of an alternative hinge track cross section 500 with an internal headboard car 528. The cross section 500 includes a pair of substantially parallel batten guide arms 504 that form a batten guide 502, which connects to a luff rope slot 508 via a luff passage 506. Each batten guide arm 504 terminates in a hook shape 512 or similar configuration that defines a headboard car channel 510 inside the batten guide 502. The internal headboard car 528, which may be round or disc-shaped (i.e., shaped like a hockey puck), travels in the space defined by the batten guide 502 along an axis defined by the headboard car channel 510. The hooks 512 retain the headboard car 528 within the batten guide 502.

The batten guide 502 receives battens 32 sewn in the sail below the headboard car 528. As compressive forces push the battens 32 forward, the battens 32 push against the batten guide 502, rather than chafing against the forward edges of the sail bolt rope. Similarly, the batten guide arms 504 hold the battens 32 as the battens 32 twist and rotate, reducing friction between the battens 32 and the respective batten pockets 34.

The alternative cross section 500 also includes a connector tunnel 542 and a hinge pin tunnel 540, which are configured to retain a tensioning line 86 and limiting pins 90, respectively. The connector 542 may also be configured to receive ball joints 94 with a ball joint seat (not shown).

Of course, other configurations of headboard car channels are possible. For example, the headboard car 28 could ride on channels formed by everted channels, protrusions, or rails that stick out from a mast track 24 with the inventive luff extrusion cross section. The channels may include more than two channels on each side, or may be formed further forward or aft along the inventive luff extrusion. The channels may be integral to the cross section or may formed by additional fixing parts to the mast 20 or mast track 24.

While this invention has been particularly shown and described with references to example embodiments thereof, it will be understood by those skilled in the art that various changes in form and details may be made therein without departing from the scope of the invention encompassed by the appended claims.

For example, the generic term yacht as used herein includes sailing vessels, boats, and ships of various sizes, including mega-yachts, which may be 40 feet or longer. Similarly, the generic term sail includes mainsails, which are used primarily to propel yachts. Likewise, the generic term mast includes mainmasts and other masts. In addition, the terms luff rope, sail bolt rope, and bolt rope may be used interchangeably.

Further, the various dimensions, materials, and surface or edge processing are for purposes of non-limiting illustration. Other dimensions, materials, and manufacturing processing are suitable.

What is claimed is:

1. An articulating sail feeder for a yacht, the articulating sail feeder comprising:

an articulating column with a longitudinal axis substantially parallel to a mast of the yacht, the articulating column being formed of a plurality of track members stacked one on top of the other in a columnar arrangement and in a manner enabling the column to articulate, resulting in the track members being hinge tracks, wherein each track member is shaped to receive a luff of a sail, and the articulating column enabling lateral and rotational movement of a sail of the yacht;

a plurality of pins, each pin disposed between a respective pair of track members adjacent to each other in the columnar arrangement, for each said pair of track members, the respective pin limiting bending movement of one track member in the pair with respect to the other track member in the pair; and plural ball joints, each ball joint disposed between a respective one of said pairs of track members, the ball joints receiving a tensioning line passing through ball joints along the longitudinal axis of the articulating column.

2. The articulating sail feeder as claimed in claim 1 wherein the articulating column enables the sail to move and rotate freely in a lateral direction with limited axial twist about an axis parallel to a longitudinal axis of the mast as the sail is being furled or reefed.

3. The articulating sail feeder as claimed in claim 1 wherein the pins each include two frustums, the bases of the frustums being separated by a flange.

4. The articulating sail feeder as claimed in claim 3 wherein the frustums have a slope that allows universal axial motion.

5. The articulating sail feeder as claimed in claim 1 wherein the tensioning line includes, but is not limited to: a flexible wire, cable, rod, or synthetic rope.

6. The articulating sail feeder as claimed in claim 1 wherein adjusting tension of the tensioning line adjusts a range of motion of the articulating column.

7. The articulating sail feeder as claimed in claim 6 further including:

means for adjusting tension of the tensioning line.

8. The articulating sail feeder as claimed in claim 7 wherein the means for adjusting tension of the tensioning line are situated at either end of the tensioning line.

9. The articulating sail feeder as claimed in claim 1 wherein each track member has a cross section comprising:

a batten guide formed of two substantially parallel batten guide arms;

a luff extrusion body having a luff rope slot is formed forward of the batten guide, the luff rope slot being substantially parallel to a longitudinal axis of the mast;

a luff passage connecting the batten guide and the luff rope slot; and a channel guiding a headboard car along an axis substantially parallel to the longitudinal axis of the mast.

10. The articulating sail feeder as claimed in claim 1 coupled to a mast track for the yacht, the mast track comprising:

plural mast track sections arranged in a column, the column being attached to the mast, each section comprising an upper receiver and a lower receiver oriented along the longitudinal axis of the column; and a respective securing pin for each pair of adjacent mast track sections, each securing pin being received by a lower receiver of one mast track section and an upper receiver of an adjacent mast track section.

11. A method for feeding a sail in a yacht, the method comprising:

receiving a luff of the sail of the yacht with an articulating column having a longitudinal axis substantially parallel to a mast of the yacht, the articulating column being formed of a plurality of track members stacked one on top of the other in a columnar arrangement and in a manner enabling the column to articulate, resulting in the track members being hinge tracks, wherein each track member is shaped to receive a luff of the sail;

enabling lateral and rotational movement of the sail with the articulating column;

for each pair of track members adjacent to each other in the columnar arrangement, disposing a respective pin between the pair of track members, there being a plurality of pins in the articulating column;

for each of said pairs of track members, limiting bending movement of one track member in the pair with respect to the other track member in the pair with the respective pin; and receiving a tensioning line passing through ball joints along the longitudinal axis of the articulating column with plural ball joints, each ball joint disposed between a respective one of said pairs of track members.

12. The method as claimed in claim 11 wherein enabling lateral and rotational movement of the sail includes allowing the sail to move and rotate freely in a lateral direction with limited axial twist as the sail is being furled or reefed.

13. The method as claimed in claim 11 wherein limiting bending movement of a track member includes allowing universal axial motion.

14. The method as claimed in claim 11 further including:

adjusting tension of the tensioning line to adjust a range of motion of the articulating column.

15. The method as claimed in claim 11 wherein each track member has a cross section comprising:

a batten guide formed of two substantially parallel batten guide arms;

a luff extrusion body having a luff rope slot is formed forward of the batten guide, the luff rope slot being substantially parallel to a longitudinal axis of the mast;

a luff passage connecting the batten guide and the luff rope slot; and a channel guiding a headboard car along an axis substantially parallel to the longitudinal axis of the mast.

16. The method as claimed in claim 11 wherein the articulating column is coupled to a mast track for the yacht, the mast track comprising:

plural mast track sections arranged in a column, the column being attached to the mast, each section comprising an upper receiver and a lower receiver oriented along the longitudinal axis of the column; and a respective securing pin for each pair of adjacent mast track sections, each securing pin being received by a lower receiver of one mast track section and an upper receiver of an adjacent mast track section.

* * * * *